US007393271B2

(12) United States Patent
Green

(10) Patent No.: US 7,393,271 B2
(45) Date of Patent: Jul. 1, 2008

(54) VENTILATOR

(75) Inventor: Daniel R. Green, Chino Hills, CA (US)

(73) Assignee: Enclos Corporation, Eagan, MN (US)

( * ) Notice: Subject to any disclaimer, the term of this patent is extended or adjusted under 35 U.S.C. 154(b) by 0 days.

(21) Appl. No.: 11/184,055

(22) Filed: Jul. 18, 2005

(65) Prior Publication Data

US 2007/0015454 A1 Jan. 18, 2007

(51) Int. Cl.
*E06B 7/10* (2006.01)

(52) U.S. Cl. ..... 454/211

(58) Field of Classification Search ..... 454/211–213, 454/22, 273, 222
See application file for complete search history.

(56) References Cited

U.S. PATENT DOCUMENTS 5,194,040 A * 3/1993 Stoney ..... 454/222
5,219,312 A 6/1993 Smith
5,244,434 A 9/1993 Stoney et al.
5,558,574 A 9/1996 Peak
5,702,297 A * 12/1997 Anderson et al. ..... 454/213
6,048,266 A 4/2000 Leith
6,558,247 B1 5/2003 Peak

* cited by examiner

*Primary Examiner*—Steve McAllister
*Assistant Examiner*—Helena Kosanovic
(74) *Attorney, Agent, or Firm*—Dorsey & Whitney LLP

(57) ABSTRACT

A slot ventilator including a housing and a closure member. The housing includes a face with an airflow opening defined in said face. When the closure member is in a first position, the closure member abuts against the face and generally closes the airflow opening. When the closure member is in a second position, the closure member is offset from the face and the airflow opening is generally unobstructed by the closure member. The housing further provides a drive mechanism for displacing the closure member from the housing.

26 Claims, 19 Drawing Sheets

VENTILATOR

FIELD OF THE INVENTION

The present invention relates to apparatus for, and methods of, ventilating an occupied space of a building. More particularly, the present invention relates to surface-mounted slot ventilators and methods of ventilating rooms with such ventilators.

BACKGROUND OF THE INVENTION

Most commercial, institutional and other types of high occupancy buildings are constructed with sealed windows and use central ventilation systems to meet the minimum indoor air quality requirements of the applicable governing authorities. Typical central ventilation systems do not allow an individual to increase the amount of outside, fresh air provided to a room (e.g., an office) within a building. An individual may prefer to have an amount of outside air provided to a room that exceeds the amount provided by the central ventilation system.

Manually operable ventilators have been installed in rooms to provide individuals with the ability to obtain additional outside air (i.e., secondary ventilation). Examples of such ventilators are the slot ventilators as disclosed in U.S. Pat. No. 5,558,574 to Peak and U.S. Pat. No. 5,244,434 to Stoney et al.

Prior art slot ventilators often require relatively high manufacturing tolerances and can be difficult to assemble. Both of these factors can lead to higher manufacturing costs.

Some prior art designs have less than intuitive operational means, for example by requiring the sealing member of the slot ventilator to translate sideways and outward as it is opened. This can result in confusion for the user and damage to the slot ventilator when the user attempts to force the opening of the ventilator in an incorrect direction.

There is a need in the art for a slot ventilator that offers relatively high open areas with decreased manufacturing costs. Also, there is a need in the art for a slot ventilator that is more intuitively operative for a user.

BRIEF SUMMARY OF THE INVENTION

The present invention, in one embodiment, is a slot ventilator that includes a housing and a closure member. The housing includes a face with an airflow opening defined in said face. When the closure member is in a first position, the closure member abuts against the face and generally closes the airflow opening. When the closure member is in a second position, the closure member is offset from the face and the airflow opening is generally unobstructed by the closure member. The housing further provides a drive mechanism for displacing the closure member from the housing. In one embodiment, the drive mechanism is a shaft extending through a sleeve in the housing. The shaft extends through the sleeve in a path that is generally perpendicular to the face when the closure member displaces from the first position to the second position.

A latching mechanism is provided for latching the closure member in the first position. The latching mechanism comprises a lip portion of a block assembly of the housing and a clip portion of a clip assembly of the closure member. The clip assembly further includes a handle. The handle may be used to easily and intuitively latch the closure member in the first position when the closure member is compressed against the housing.

The slot ventilators disclosed herein may be suitable in a variety of applications. They may be used with windows that fill existing openings in a structure, such as window openings in a brick or precast stone wall. They also may be used for providing ventilation for windows in curtainwall structures, in which the external wall of a structure is not load-bearing, and instead is supported by structure such as floors. These curtainwalls must support their own loads and environmental loads, and they form an enclosure for a building. The ventilators of the present invention also may be used in any other type of window application.

While multiple embodiments are disclosed, still other embodiments of the present invention will become apparent to those skilled in the art from the following detailed description, which shows and describes illustrative embodiments of the invention. As will be realized, the invention is capable of modifications in various aspects, all without departing from the spirit and scope of the present invention. Accordingly, the drawings and detailed description are to be regarded as illustrative in nature and not restrictive.

DETAILED DESCRIPTION

A slot ventilator adapted to be installed in a windowsill or an exterior wall to provide ventilation to a room is provided. The slot ventilator allows a user to intuitively open and close the ventilator, thereby decreasing the chance that the slot ventilator will be damaged when being operated. The slot ventilator further provides for partial opening or closing of the ventilator.

Figure 1:
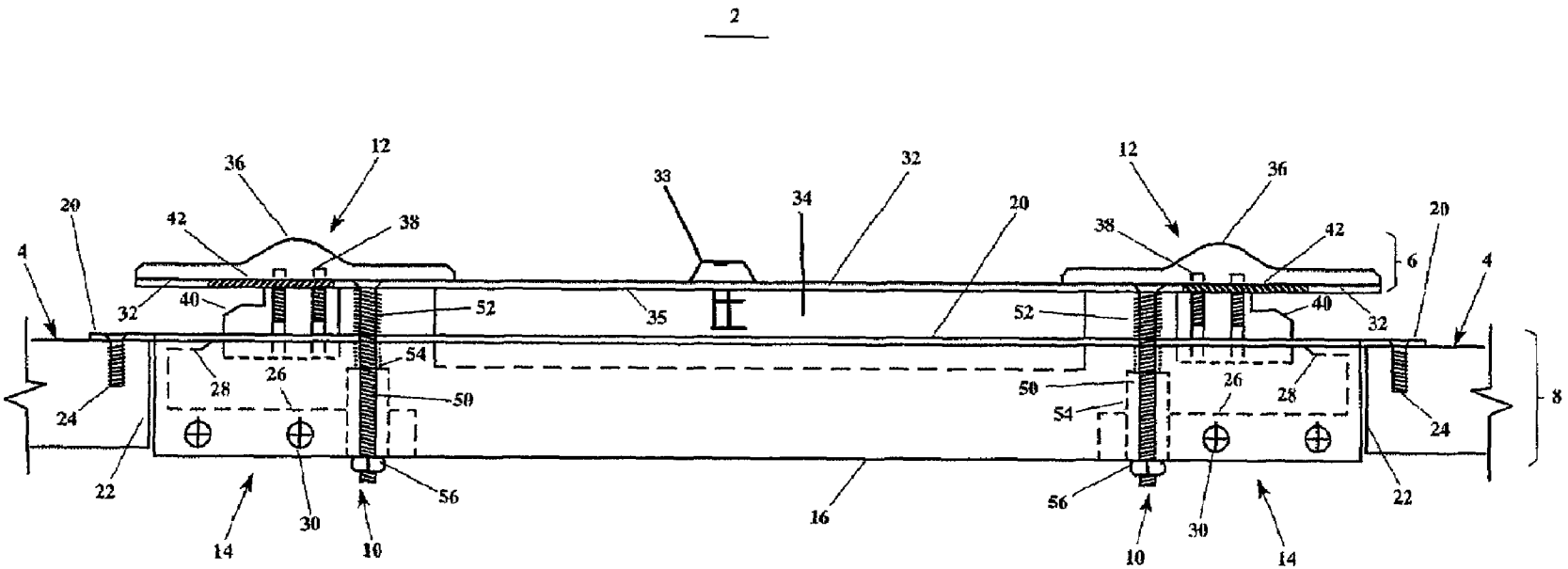
FIG. 1 is side elevation view of a slot ventilator mounted in a windowsill and opened to allow ventilation airflow through the ventilator in accordance with a first embodiment of the present invention.
Figure 2:
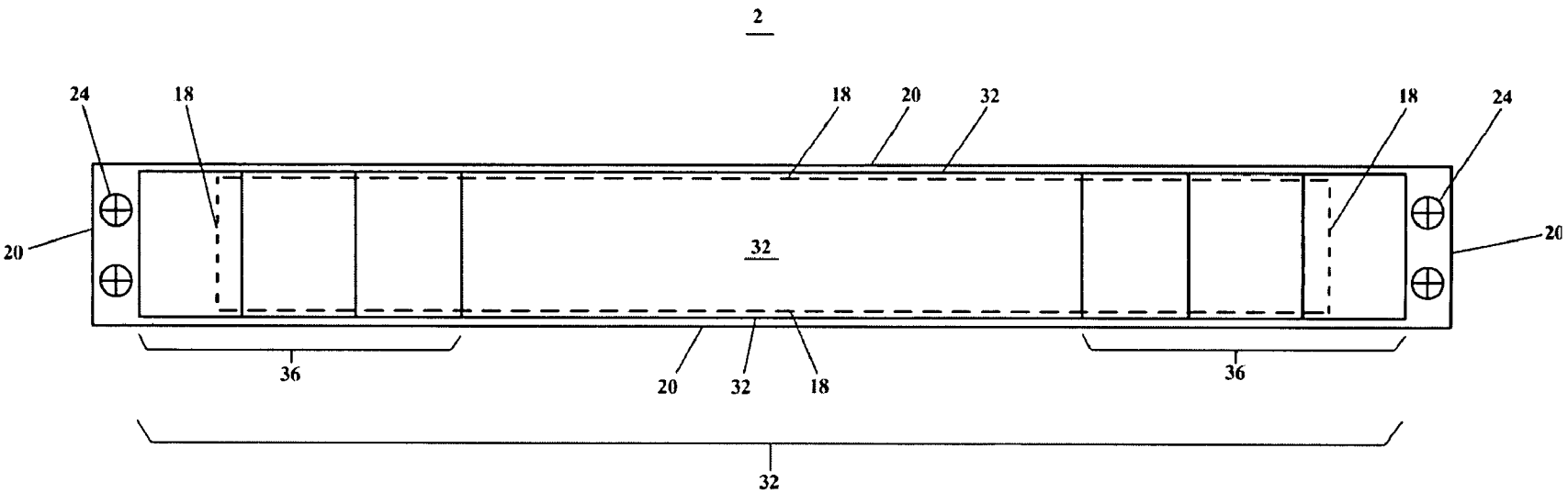
FIG. 2 is a plan view of the slot ventilator in the open state illustrated in FIG. 1.
Figure 3:
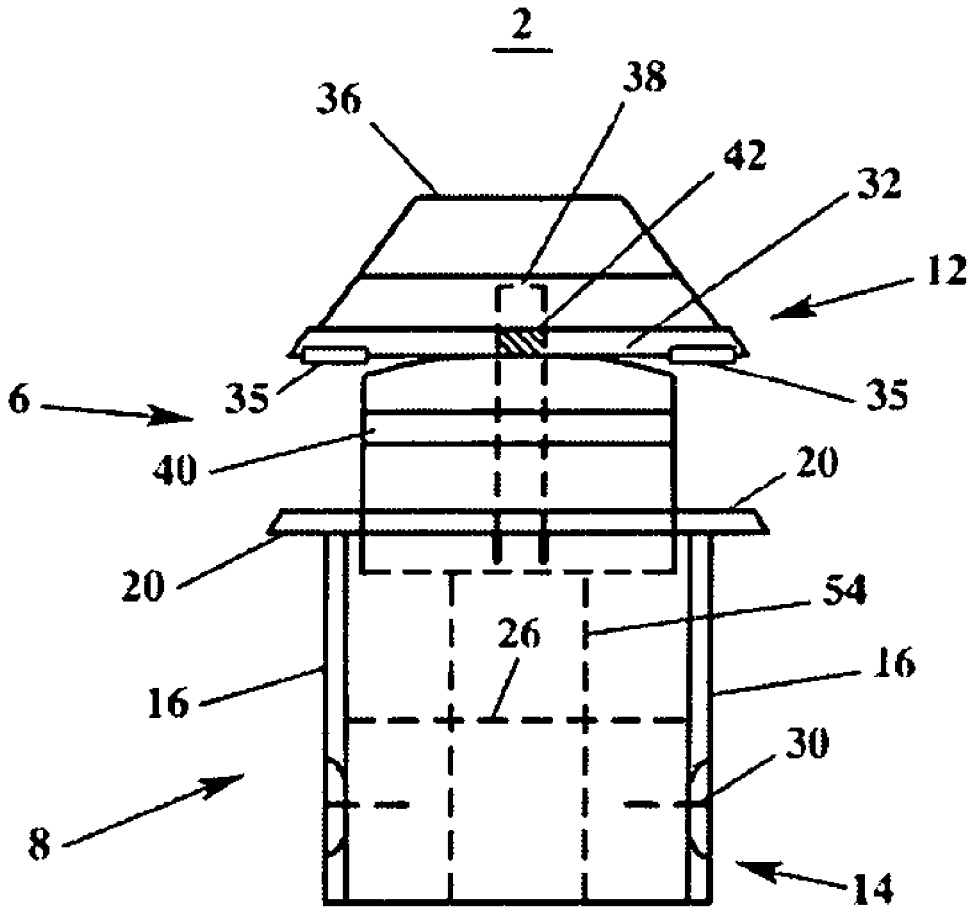
FIG. 3 is an end elevation view of the slot ventilator in the open state illustrated in FIG. 1.

FIGS. 1 through 8 illustrate a first embodiment of a ventilator in accordance with the present invention. FIG. 1 is a side elevation view of the slot ventilator 2 mounted in a windowsill 4 and opened to allow ventilation airflow through the ventilator 2. FIG. 2 is a plan view of the slot ventilator 2 in the open condition illustrated in FIG. 1. FIG. 3 is an end elevation view of the slot ventilator 2 in the open condition illustrated in FIG. 1.

As shown in FIGS. 1 through 3, in one embodiment, the ventilator 2 includes an elongated closure member 6, an elongated housing 8, two shaft assemblies 10, two clip assemblies 12 and two block assemblies 14. The housing 8, as shown, includes opposed continuous sidewalls 16 (see FIG. 7), an elongated rectangular airflow opening 18 (hidden lines in FIG. 2), and a top rim 20 bordering the airflow opening 18 and perpendicularly intersecting the sidewalls 16. The airflow opening 18 is adapted to receive the closure member 6 and serves as a pathway through which ventilation air passes when the ventilator 2 is in the open condition.

The elongated housing 8 and the closure member 6 may be formed of a metal such as aluminum. Alternately, the elongated housing 8 and the closure member 6 may be formed of a polymer material or any other suitable material. Each of the various components of the ventilator may be formed of any suitable material or combination of materials, as will be apparent to those skilled in the field.

As can be understood from FIG. 1, when the ventilator 2 is installed in a windowsill 4, the bottom surface of the rim 20 rests on the windowsill 4 and the sidewalls 16 extend vertically downward into an opening 22 made in the windowsill 4 to receive the ventilator 2. While FIG. 1 illustrates a ventilator installed in a windowsill provided at a bottom of a window opening, it should be understood that the ventilator may be provided at any orientation or at any suitable location. Thus, for example, the ventilator may be provided along a side or top of the window opening as well as along the bottom of the window opening. Similarly, the ventilator may be provided as part of a curtainwall, discussed more fully below, or as part of a window wall.

As indicated in FIGS. 1 and 2, at each end of the elongated housing 8, a pair of screws 24 extends through the top rim 20 and into the windowsill 4 to secure the housing 8 to the windowsill 4. Alternately, any suitable means of securing the housing 8 to the windowsill 4 may be used. For example, snap-fit structures or tabs, welding, friction fit, or any other suitable design may be used to secure the housing 8 to the windowsill 4.

As shown in FIG. 1, each end of the housing 8 includes a block assembly 14 mounted therein. One embodiment of a block assembly 14 is further illustrated in FIG. 8. In the embodiment shown, each block assembly 14 includes a base portion 26 and a lip portion 28. The base portion 26 is secured between the sidewalls 16 via fasteners such as bolts or screws 30. Any other suitable fastener may be used to secure the base portion 26 between the sidewalls 16. The lip portion 28 serves as a first half of a latch mechanism that is used to secure the closure member 6 against the housing 8 when the ventilator 2 is closed, as will be described more fully below.

The portions of the block assembly 14 may be made from a metal such as aluminum, a polymer material, or any other suitable material. Further, the block assembly 14 may be formed entirely from a metal material, entirely from a polymer material, or from two or more different materials.

Figure 5:
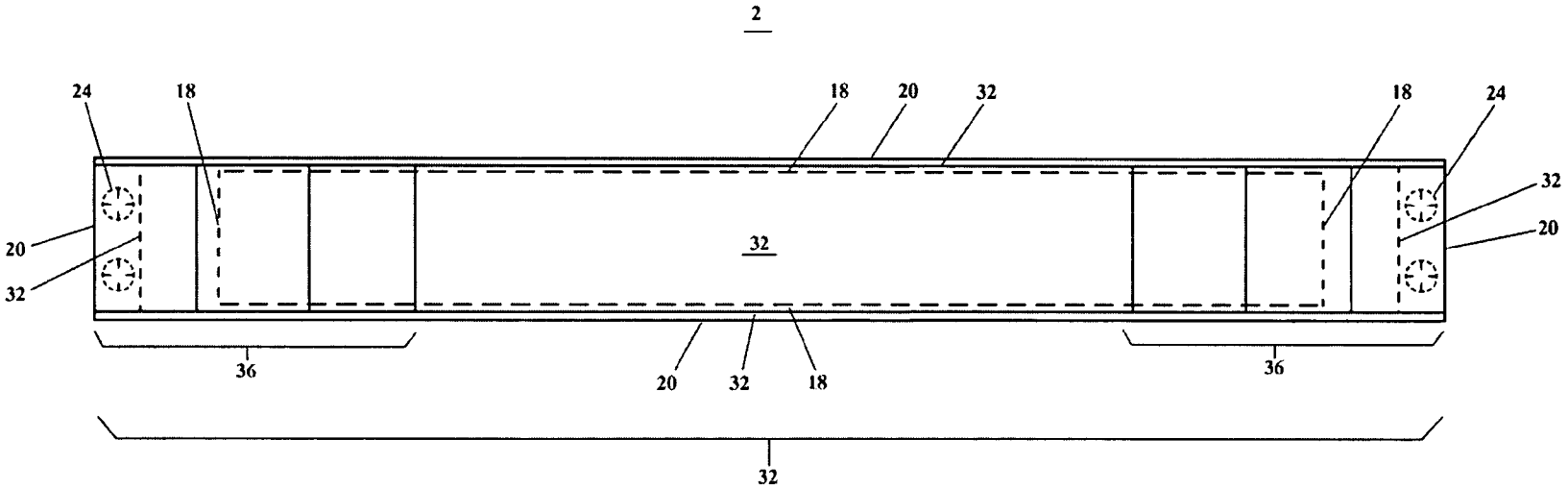
FIG. 5 is a plan view of the slot ventilator in the closed state illustrated in FIG. 4.

As illustrated in FIGS. 1 through 3, the closure member 6 includes a generally planar top portion 32 that runs for a portion of the length of the housing 8 and is perpendicularly intersected by a reinforcing portion 34. The top portion 32 may run the full length of the housing 8 or a portion shorter than the full length of the housing 8. As shown in FIGS. 2 and 5, slots 35 may be provided in the top surface and may be opened or closed, such as with a sliding cover, for partial venting without requiring movement of the closure member 6.

Figure 6:
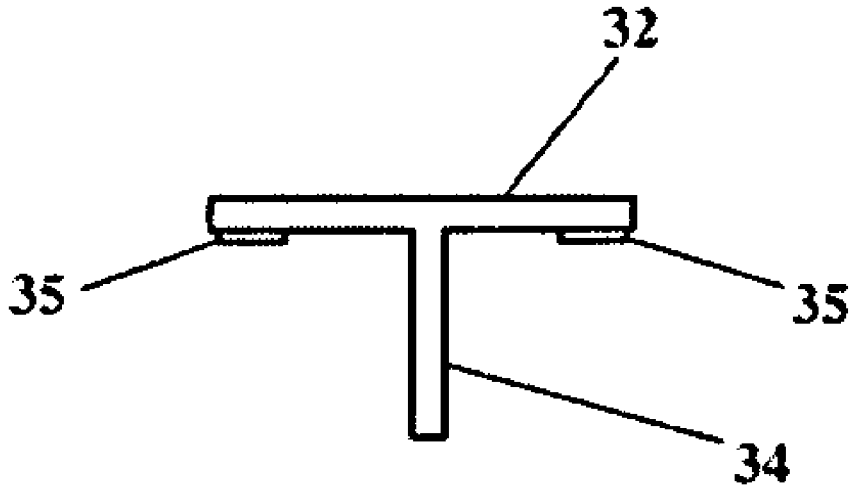
FIG. 6 is an end elevation view of a closure member and reinforcing portion of a slot ventilator in accordance with a first embodiment of the present invention.
Figure 7:
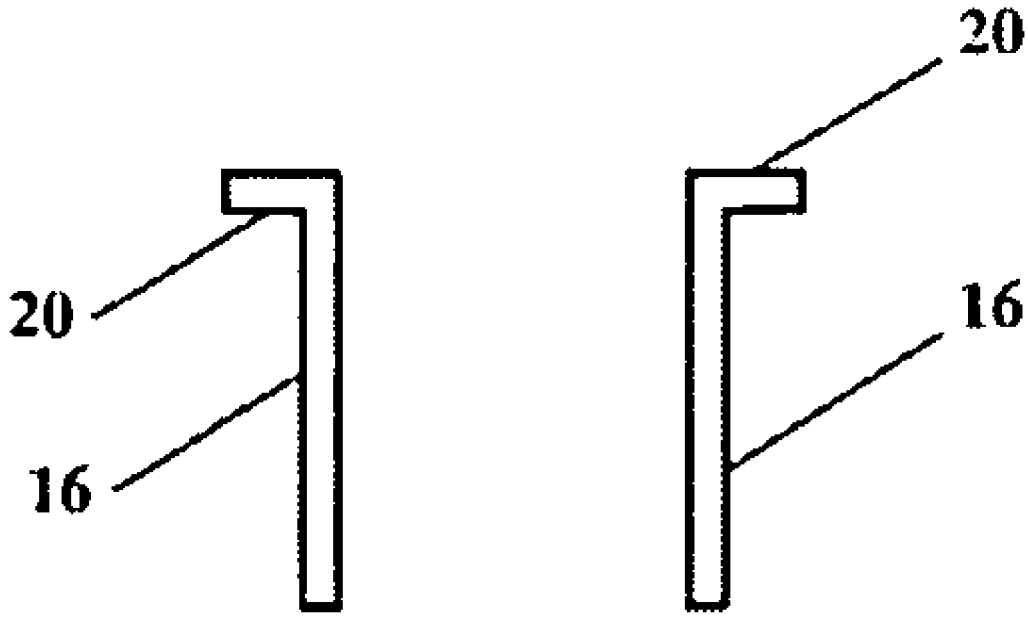
FIG. 7 is an end elevation view of a housing of a slot ventilator in accordance with a first embodiment of the present invention.
Figure 8:
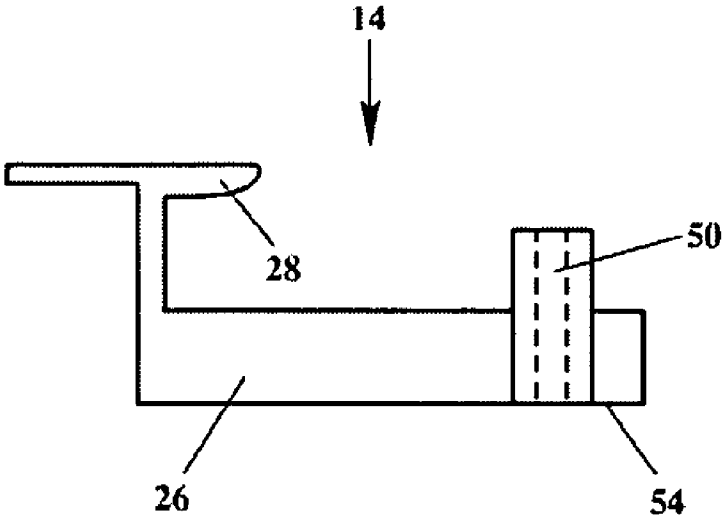
FIG. 8 is a side elevation view of a block assembly of a slot ventilator in accordance with a first embodiment of the present invention.

FIG. 6 further illustrates the top portion 32 and reinforcing portion 34. The reinforcing portion 34 may be positioned approximately central first and second outer edges of the top portion 32 and may extend downwardly from the top portion 32. The reinforcing portion 34 may be provided as a single piece of material, as two or more pieces of material or in any suitable configuration. Further, the reinforcing portion 34 may be formed of a metal material, a polymer material or any other suitable material.

As shown in FIGS. 1, 3 and 6, gaskets 35 may be provided along the bottom surface of the top portion 32 near the top portion's outer edges. The gaskets 35 aid in preventing airflow leakage when the ventilator is closed and prevent metal-on-metal wear between the top portion 32 and the housing 8. In one embodiment, the gaskets 35 are a fabric material such as felt. In another embodiment, the gaskets 35 are a polymer material such as a plastic or rubber foam. Alternately, the gaskets 35 may be formed of any suitable material. The gaskets 35 may be provided along all or part of the length of the top portion and may be provided along all or part of the extension of the top portion from the reinforcing portion 34. In one embodiment, the gaskets 35 are provided proximate outer edges of the bottom surface of the top portion 32 and extend a length of the top portion corresponding with the length of the housing 8.

As can be understood from FIG. 1, in one embodiment, when the closure member 6 is in the open position, the reinforcing portion 34 is at least partially recessed within the airflow opening 18. In the embodiment shown in FIGS. 1 through 8, the reinforcing portion 34 extends along a length of the housing 8 shorter than the full length of the housing 8 and between the block assemblies 14.

As discussed above, each end of the housing 8 includes a block assembly 14 mounted therein, each block assembly including a base portion 26 and a lip portion 28. The lip portion 28 serves as a first half of a latch mechanism that is used to secure the closure member 6 against the housing 8 when the ventilator 2 is closed.

A clip assembly 12 is positioned at each end of the closure member 6, as shown in FIG. 1. Each clip assembly 12 includes a handle portion 36 affixed via screws or bolts or other suitable fastener 38 to a clip portion 40. The handle portion 36 may be provided in any suitable configuration. For example, the handle may be provided as a slide-type handle, as shown, a knob or any other functional or ornamental design configuration.

Each clip portion 40 of the clip assembly 12 is adapted to mate with a respective lip portion 28 and serves as a second half of the latch mechanism that is used to secure the closure member 6 against the housing 8 when the ventilator 2 is closed. The portions of the clip assembly 12 may be made from a metal such as aluminum, a polymer material, or other suitable material. Further, the clip assembly 12 may be made entirely of a metal material, entirely of a polymer material or from two ore more different materials. For example, in one embodiment, the handle portion 36 is made of a polymer material and the clip portion 40 is made of a metal such as aluminum.

Figure 17:
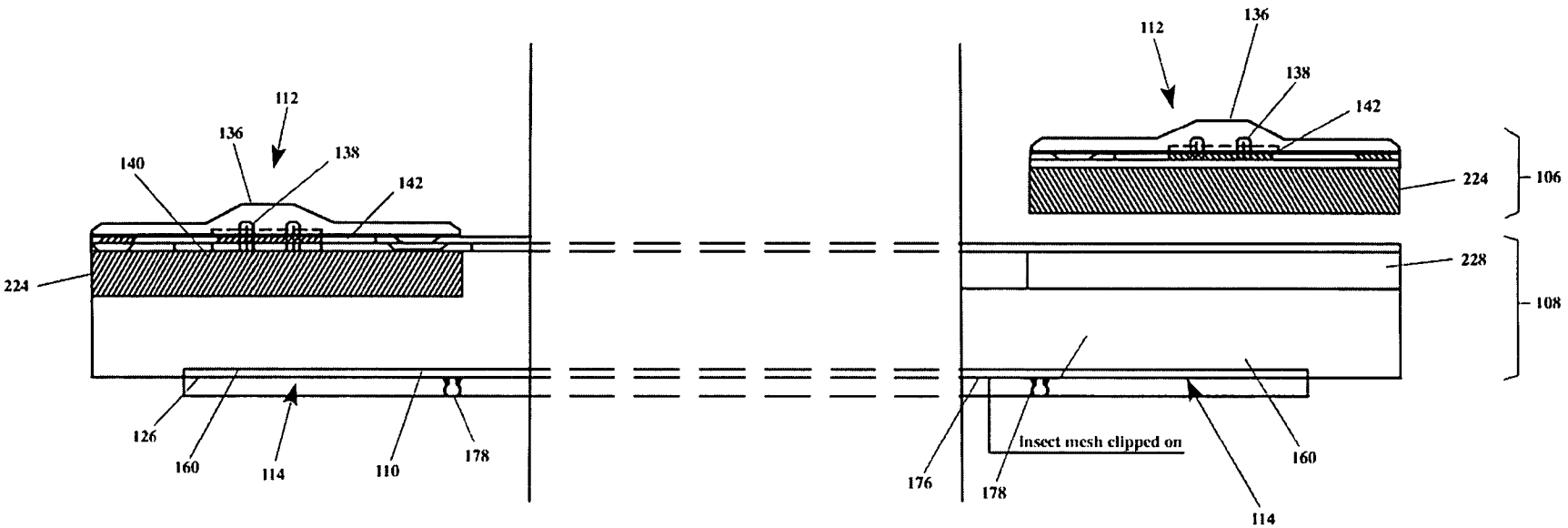
FIG. 17 is a side elevation view of a slot ventilator including a friction fit closure mechanism opened to allow ventilation airflow through the ventilator in accordance with one embodiment of the present invention.

Thus, the latch mechanism comprises the lip portion 28 of the block assembly 14 and the clip portion 40 of the clip assembly 12. The latch mechanism is one embodiment of a possible closure for the ventilator. In other suitable closure mechanism may alternately be used. For example, the ventilator may include a friction fit closure mechanism, a cam closure mechanism or other suitable mechanism. As discussed more fully in relation to FIG. 17, with suitable configurations, the closure mechanism may be configured for partial opening such that the ventilator may be partially opened rather than only fully opened or fully closed. For example, using a cam closure mechanism, as the ventilator is opened, the opening may be adjusted. Further, in order to provide partial ventilation, one latch mechanism may be closed and the other latch mechanism open.

In a further embodiment, the latch mechanism may be configured for key-control having a keylock 33. Thus, for example, the latch mechanism may be configured to require a key to enable opening or closing of the ventilator. This may be advantageous in situations where it is desirable for a limited number of individuals to have the ability to open or close the ventilator. Any suitable key configuration, as will be known to those in the art, may be used.

As shown in FIGS. 1 and 3, a slot 42 is located at each end of the closure member 6. In the embodiment shown, each slot 42 is centered on, and extends along, the longitudinally oriented centerline of the planar top portion 32. The exact placement of the slot 42 may vary so long as it corresponds with the placement of the clip assembly 12. The bolts 38 of each clip assembly 12 pass through, and are displaceable along, their respective slot 42. Thus, each clip assembly 12 may displace longitudinally along its respective slot 42 to engage or disengage the respective clip portion 40 from the block assembly 14.

As illustrated in FIG. 1, each shaft assembly 10 includes a shaft 50, a spring 52, a sleeve 54 and a bottom stop 56. Each shaft 50 is affixed to the bottom side of the planar top portion 32 and extends down through its respective spring 52 and sleeve 54 to terminate with a bottom stop 56. In one embodiment, the bottom stop 56 is a threaded lock nut 56 (e.g., a Nylock nut) that is threaded onto the shaft 50, which is also threaded. Employing threaded nuts 56 and shafts 50 allow the displacement distance between a planar top portion 32 and a top rim 20 to be adjusted to an optimum distance prior to the installation of a ventilator 2 in a windowsill 4. Alternately, the bottom stop 56 may be provided in any suitable configuration.

While a vertical drive mechanism for lifting the planar top portion 32 is disclosed (the shaft 50 being driven by the spring 52, thereby displacing the planar top portion 32), alternate drive mechanisms as known in the art are within the scope of the invention. For example, a cam drive mechanism may be used to displace the planar top portion 32. The drive mechanism may further provide for adjustable displacement of the planar top portion 32. Thus, for example, using a cam drive mechanism, as the ventilator is opened or closed, the extent of the opening may be adjusted.

As shown in FIG. 1, in one embodiment, the sleeve 54 is affixed to the base portion 26. In another embodiment, the sleeve 54 is integral with the base portion 26 (i.e., the sleeve 54 is formed as part of the base portion 26 or is a hole drilled through the base portion 26).

Figure 4:
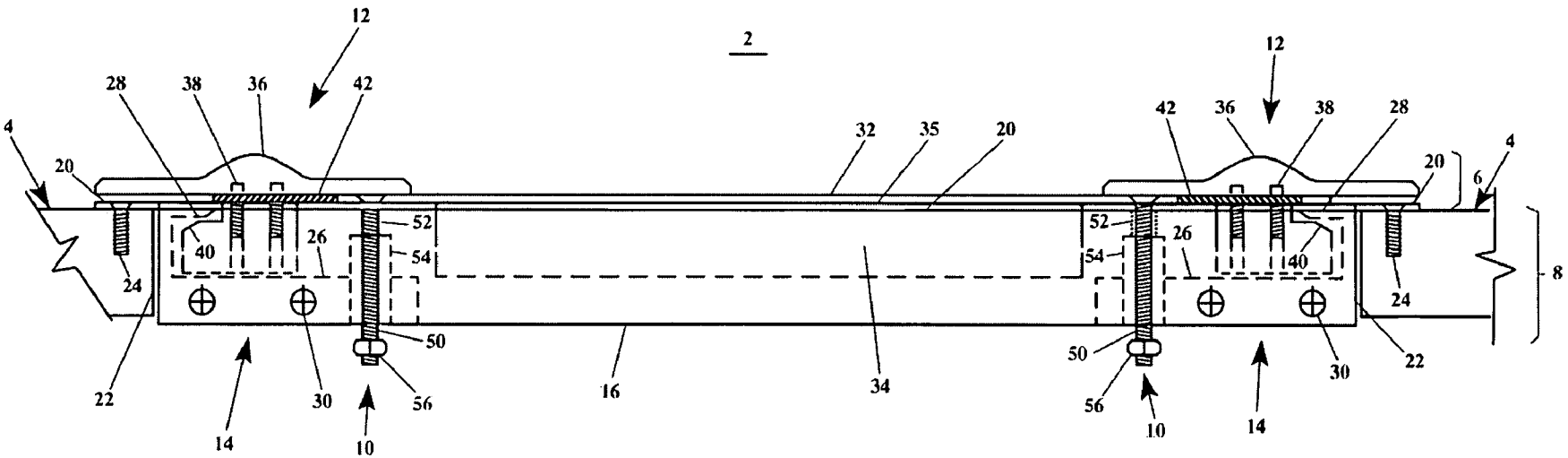
FIG. 4 is side elevation view of a slot ventilator mounted in a windowsill and closed to prevent ventilation airflow through the ventilator in accordance with a first embodiment of the present invention.

The surface of the top rim 20 that faces the closure member 6 is the face of the elongated housing 8, and the surface of the closure member 6 that has the handle portions 26 is the face of the closure member 6. Thus, as illustrated in FIGS. 1 and 4, when the slot ventilator 2 is installed in a windowsill 4, the face portions of the housing 8 and the closure member 6 face outward into the office or room intended to receive the ventilation air through the ventilator 2. The outward surface of the generally planar top portion 32 may be printed with text or a logo for display in the office or room.

In operation, as can be understood from FIG. 1, a user may open the ventilator 2 by sliding one or both handles 36 longitudinally towards the midpoint of the closure member 6 (i.e., the ventilator 2 may be opened by moving one handle 36 towards the other handle 36 or by moving both handles 36 towards one another). This causes each clip portion 40 to disengage from its respective lip portion 28 and frees the closure member 6 to be displaced upwardly away from the housing 8 by the springs 52 acting against the bottom of the planar top portion 32 and their respective sleeves 54. Allowing the closure member 6 to displace upwardly unblocks the airflow opening 18 to allow ventilation air to flow through the ventilator 2. As can be understood from FIGS. 1 and 2, when the handles 36 are moved toward each other, the screws 24 become exposed. For a discussion of the slot ventilator 2 in its closed configuration, reference is now made to FIGS. 4 and 5. FIG. 4 is side elevation view of the slot ventilator 2 mounted in a windowsill 4 and closed to prevent ventilation airflow through the ventilator 2. FIG. 5 is a plan view of the slot ventilator 2 in the closed condition illustrated in FIG. 4.

As can be understood from FIGS. 4 and 5, to close the ventilator 2, the user presses the closure member 6 down until the bottom of the planar top portion 32 abuts the top of the rim 20. The user then slides each handle 36 longitudinally away the midpoint of the closure member 6 (i.e., the ventilator 2 may be closed by diverging the handles 36 away each other). This causes each clip portion 40 to engage its respective lip portion 28 and maintain the closure member 6 in the closed position. Placing the closure member 6 in the closed position blocks the airflow opening 18 and prevents ventilation air from flowing through the ventilator 2.

As shown in FIG. 4, when the closure member 6 is in the closed position, the reinforcing portion 34 is generally completely recessed within the airflow opening 18. Also, as indicated in FIGS. 4-5, when the handles 36 are diverged from each other to latch the closure member 6 in the closed position, the screws 24 are covered.

Figure 9:
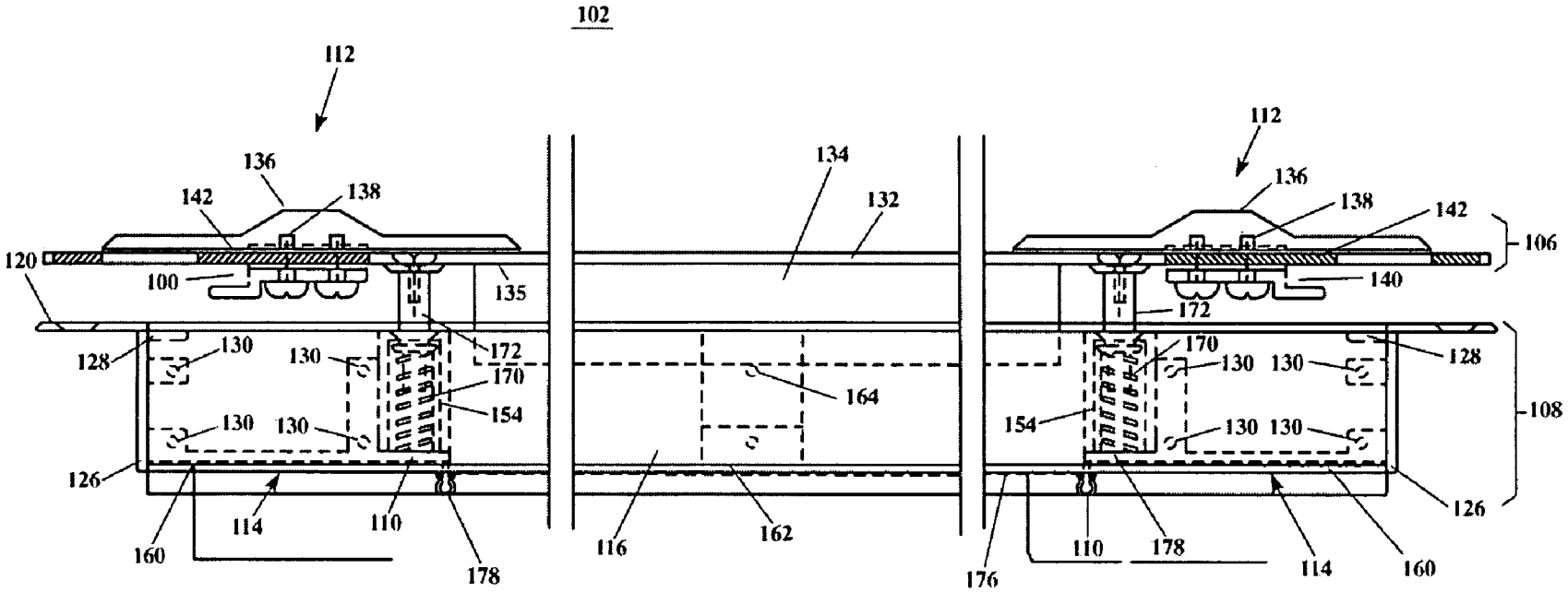
FIG. 9 is side elevation view of a slot ventilator opened to allow ventilation airflow through the ventilator in accordance with a second embodiment of the present invention.
Figure 10:
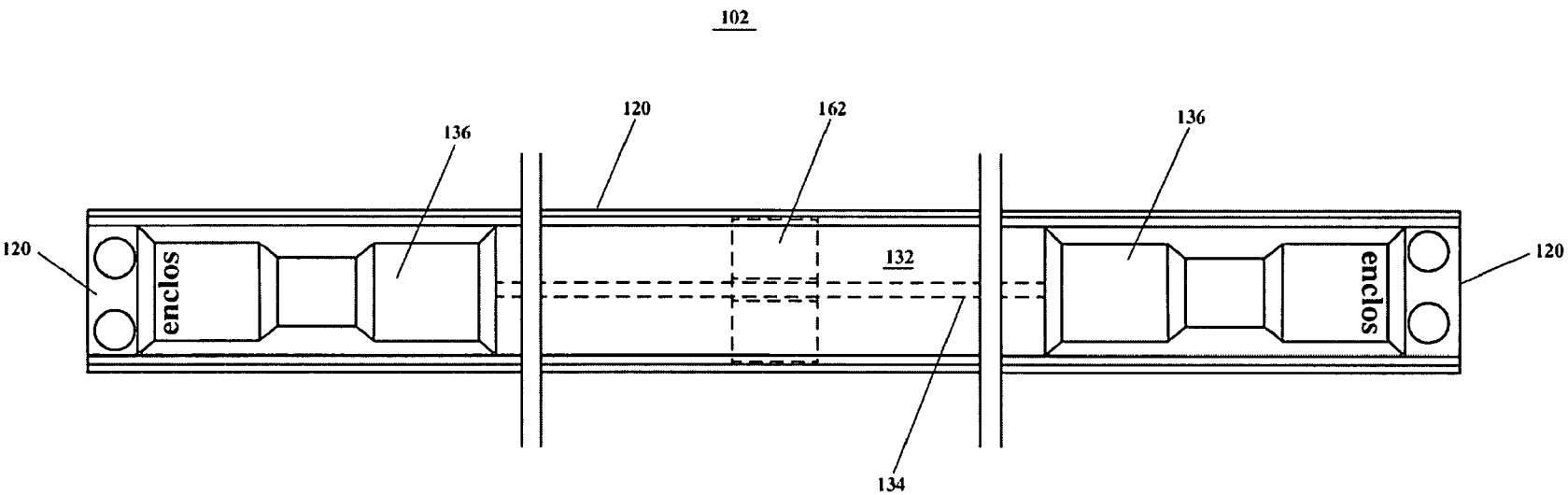
FIG. 10 is a plan view of the slot ventilator in the open state illustrated in FIG. 9.
Figure 11:
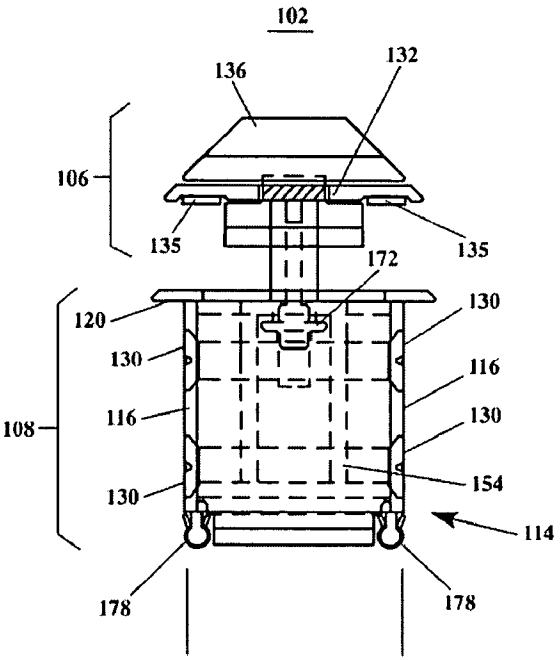
FIG. 11 is an end elevation view of the slot ventilator in the open state illustrated in FIG. 9.

FIGS. 9 through 14 illustrate a second embodiment of a ventilator in accordance with the present invention. FIG. 9 is side elevation view of the slot ventilator 102 in an open configuration to allow ventilation airflow through the ventilator 102. FIG. 10 is a plan view of the slot ventilator 102 in the open condition illustrated in FIG. 9. FIG. 11 is an end elevation view of the slot ventilator 102 in the open condition illustrated in FIG. 9.

In some respects, the ventilator of FIGS. 9 through 14 corresponds with the ventilator of FIGS. 1 through 8. Like element numbers are thus used for corresponding structures. For example, the ventilator 2 of FIGS. 1 through 8 includes an elongated closure member 6, an elongated housing 8, two shaft assemblies 10, two clip assemblies 12 and two block assemblies 14 and the ventilator 102 of FIGS. 9 through 11 includes an elongated closure member 106, an elongated housing 108, two shaft assemblies 110, two clip assemblies 112 and two block assemblies 114. Only differences between the two embodiments will thus be described.

As shown in FIG. 9, each end of the housing 108 includes a block assembly 114 mounted therein. The block assembly 114 is provided within an end block 160. The end block 160 be formed of a polymer material, a metal material or any other suitable material. Each block assembly 114 includes a base portion 126 and a lip portion 128. The end block 160 is secured between the sidewalls 116 via fasteners such as bolts or screws 130. Any other suitable fastener may be used to secure the end block 160 between the sidewalls 116.

A mid-block 162 may be provided between the ends of the housing 108. The mid-block 162 may be formed of a polymer material, a metal material or any other suitable material. The mid block 162 is secured between the sidewalls 116 via fasteners such as bolts or screws 164. The end blocks 160 and the mid-block 162 serve to reinforce the structure of the housing 108.

As discussed above, each end of the housing 108 includes a block assembly 114 mounted therein, each block assembly including a base portion 126 and a lip portion 128. The lip portion 128 serves as a first half of a latch mechanism that is used to secure the closure member 106 against the housing 108 when the ventilator 102 is closed.

As illustrated in FIG. 9, a clip assembly 112 is positioned at each end of the closure member 6. Each clip assembly 112 includes a handle portion 136, such as a slide grip, affixed via screws or bolts or other suitable fastener 138 to a clip portion 140. Each clip portion 140 is adapted to mate with a respective lip portion 128 and serves as a second half of the latch mechanism that is used to secure the closure member 106 against the housing 108 when the ventilator 102 is closed. As shown, the clip assembly 112 is relatively low profile with the clip portion 40 dictating the profile of the clip assembly 112. The portions of the clip assembly 112 may be made from a metal such as aluminum, a polymer material, or other suitable material. Further, the clip assembly 112 may be made entirely of a metal material, entirely of a polymer material or from two ore more different materials. For example, in one embodiment, the handle portion 136 is made of a polymer material and the clip portion 140 is made of a metal such as aluminum.

Thus, the latch mechanism comprises the lip portion 128 of the block assembly 114 and the clip portion 140 of the clip assembly 112.

As illustrated in FIG. 9, each shaft assembly 110 includes a spring 170, a sleeve 154 and a shaft 172. Each block assembly 114 extends beneath the shaft assembly 110, thereby forming a bottom stop at the intersection of the shaft assembly 110 with the block assembly 114. Each shaft 172 is affixed to the bottom side of the planar top portion 132 and extends partially through its respective spring 170 and sleeve 154. In the open position of the ventilator 102, the shaft 172 terminates somewhat above the block assembly 114.

Figure 12:
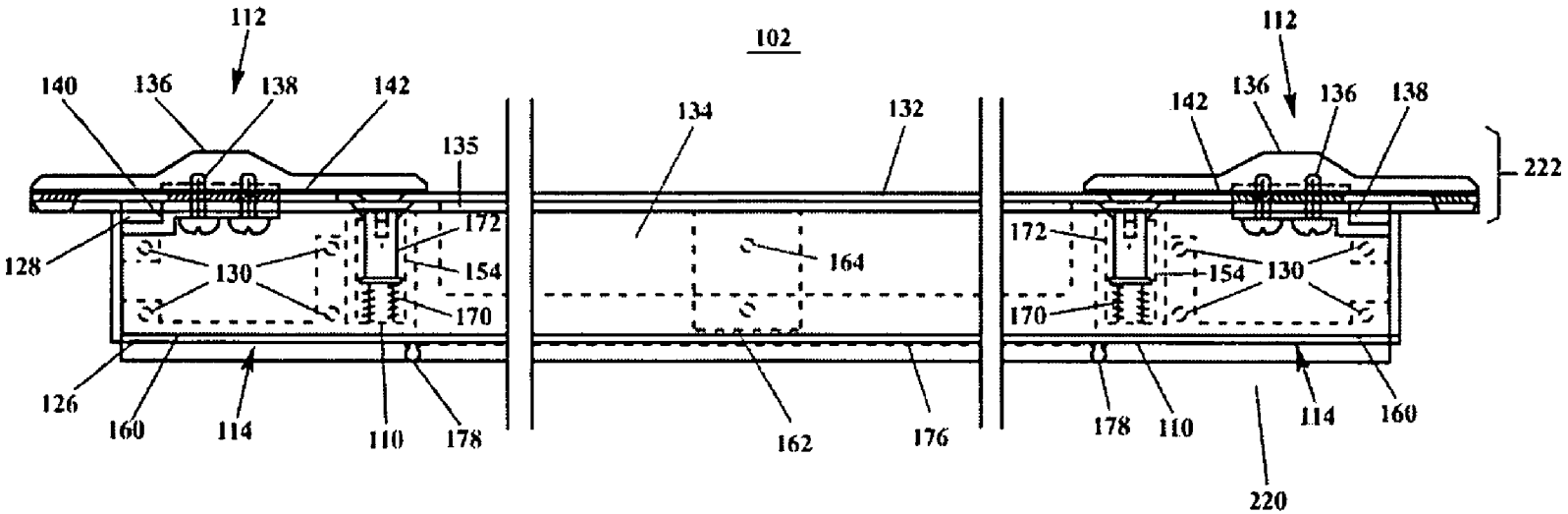
FIG. 12 is a side elevation view of a slot ventilator closed to prevent ventilation airflow through the ventilator in accordance with one embodiment of the present invention.

An insect mesh or screen 178 may be coupled to the housing 108, as shown in FIGS. 9 and 12. In the embodiment shown, clips 178 are provided along a bottom surface of the housing 108. The insect mesh 178 is clipped to the clips 178 of the housing 108 via corresponding clips on the mesh 178.

In operation, as can be understood from FIG. 9, a user may open the ventilator 102 by sliding one or both handles 136 longitudinally towards the midpoint of the closure member 106. This causes each clip portion 140 to disengage from its respective lip portion 128 and frees the closure member 106 to be displaced upwardly away from the housing 108 by the springs 154 forcing their respective shafts 172 upwardly, the shafts 172 in turn pushing against the bottom of the planar top portion 132. The closure member 106 is thus displaced upwardly, thereby unblocking the airflow opening 118 to allow ventilation air to flow through the ventilator 102.

Figure 13:
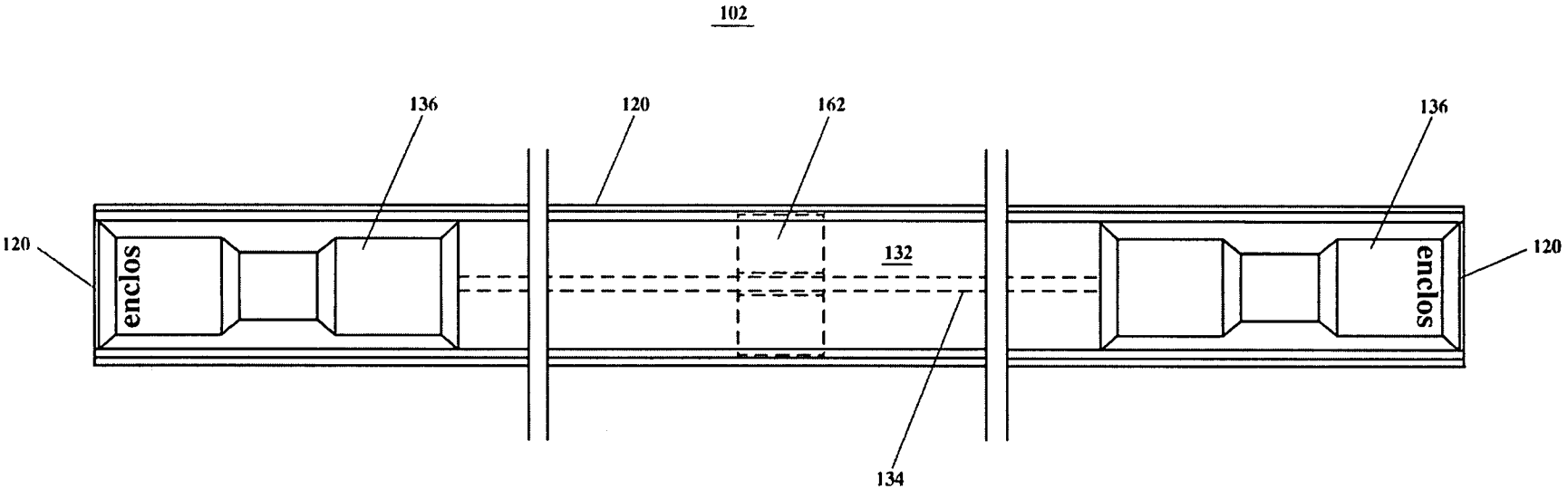
FIG. 13 is a plan view of the embodiment of the slot ventilator in the closed state illustrated in FIG. 12.
Figure 14:
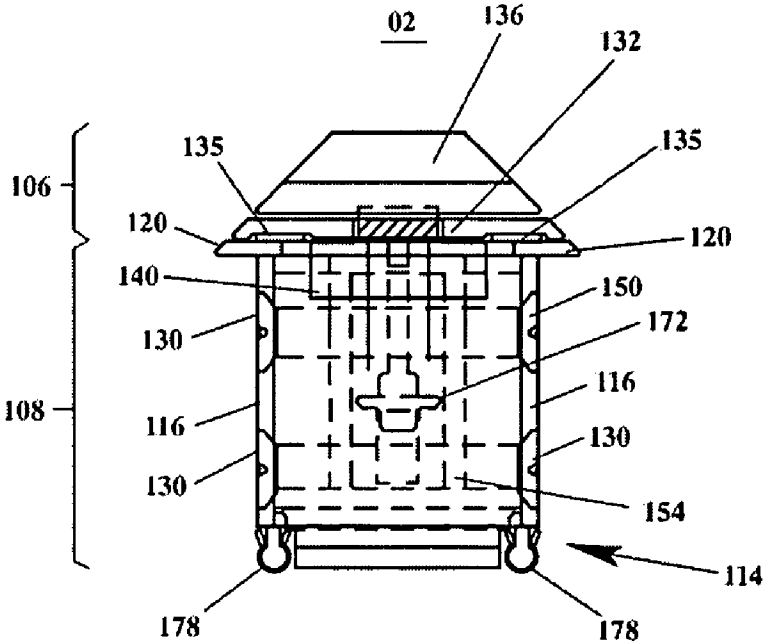
FIG. 14 is an end elevation view of the slot ventilator in the closed state illustrated in FIG. 12.

For a discussion of the slot ventilator 102 in its closed configuration, reference is now made to FIGS. 12, 13 and 14. FIG. 12 is side elevation view of the slot ventilator 102 in a closed configuration to prevent ventilation airflow through the ventilator 102. FIG. 13 is a plan view of the slot ventilator 102 in the closed condition illustrated in FIG. 12. FIG. 14 is an end elevation view of the slot ventilator 102 in the closed condition illustrated in FIG. 12.

As can be understood from FIGS. 12 through 14, to close the ventilator 102, the user presses the closure member 106 down until the bottom of the planar top portion 132 abuts the top of the rim 120. The user then slides each handle 136 longitudinally away the midpoint of the closure member 106. This causes each clip portion 140 to engage its respective lip portion 128 and maintain the closure member 106 in the closed position. Placing the closure member 106 in the closed position blocks the airflow opening 118 and prevents ventilation air from flowing through the ventilator 102.

Figure 15:
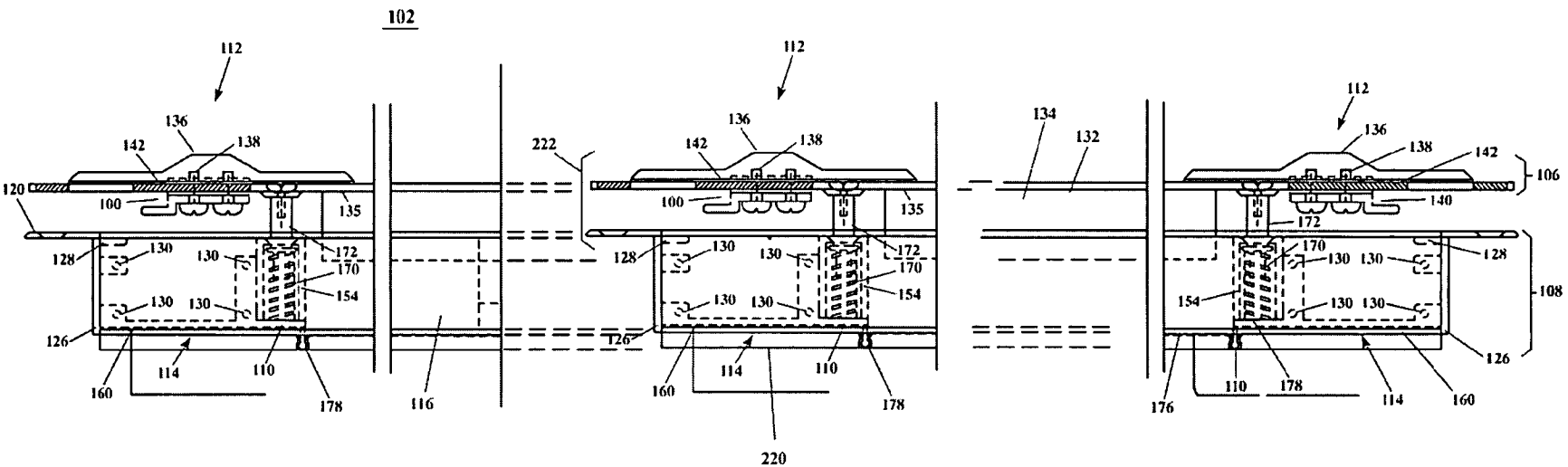
FIG. 15 is a side elevation view of a slot ventilator opened to allow ventilation airflow through the ventilator in accordance with a second embodiment of the present invention.
Figure 16:
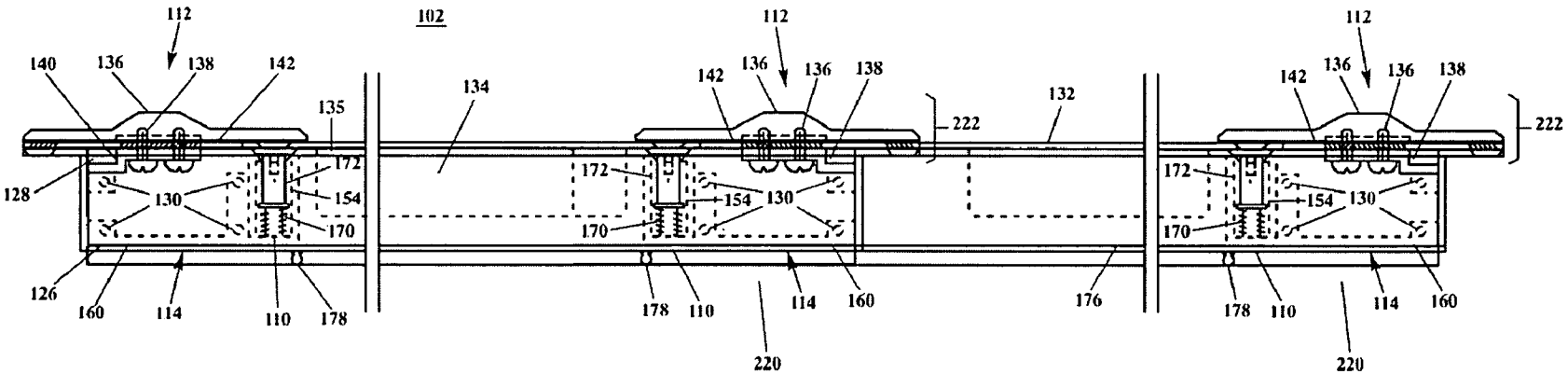
FIG. 16 is a side elevation view of a slot ventilator closed to prevent ventilation airflow through the ventilator in accordance with one embodiment of the present invention.

Ventilators that span long openings may be subject to deflection, and may not form a proper seal between the two opposite ends. As shown in FIGS. 15 and 16, one or more block assemblies 220 and clip assemblies 222 may be provided intermediate the two opposite ends. Thus, one or more latch mechanisms, each latch mechanism comprising a lip portion of a block assembly and a clip portion of a clip assembly, may be provided intermediate opposite ends of the ventilator. The seal also can be supplemented by other means, including magnetic materials. FIG. 15 illustrates a ventilator 102 comprising intermediate block and clip assemblies, 220 and 222 respectively, in an open condition. FIG. 16 illustrates a ventilator comprising intermediate block and clip assemblies, 220 and 222 respectively, in a closed condition.

As discussed above, any suitable latch mechanism for latching the closure member to the housing may be used. In some embodiments, partial closure of the ventilator may be desired A suitable closure mechanism for a latch mechanism thus may comprise a friction fit closure, shown in FIG. 17 or a cam mechanism, shown in FIG. 18. Using a friction fit closure, the latch mechanism 224 comprises a sealing assembly in the closure member 106 that is received in an opening 226 of the housing 108. The latch mechanism 224 and opening 226 fit in a friction fit. The closure member 106 may be compressed against the housing 108 to a position fully against the housing 108 wherein the ventilator 102 is in a completely closed condition or to a position less than fully against the housing 108 where the ventilator 102 is in a partially open state.

Figure 18:
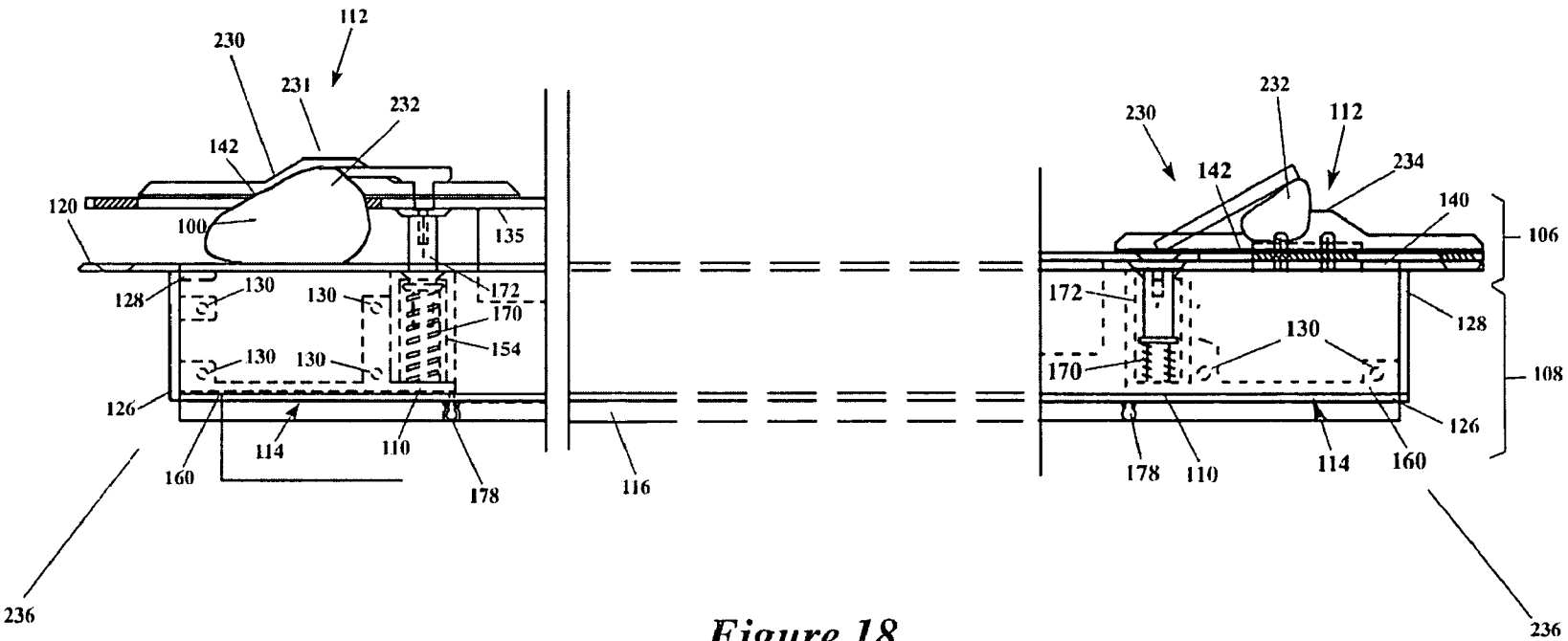
FIG. 18 is a side elevation view of a slot ventilator including a cam closure mechanism opened to allow ventilation airflow through the ventilator in accordance with one embodiment of the present invention.

As shown in FIG. 18, a cam closure mechanism 230 may be provided. Using the cam closure mechanism 230, as the ventilator 102 is opened, the opening may be adjusted. The shaft assembly includes a rotating portion 232, a shaft 50, and a spring 52, a sleeve 54 and a bottom stop 56. The handle 234 communicates with the rotation portion 232 such that sliding of the handle 234 rotates the rotation portion 232 which in turn moves the shaft 50 through the sleeve 54 against the spring 52. The spring 52, in turn, is compressed the bottom stop 56. When the handle 234 is in a position most towards the end 236 of the ventilator 102, the ventilator 102 is in a fully closed position. When the handle 234 is in a position most towards a center of the ventilator 102, the ventilator 102 is in a fully open position. At positions of the handle 234 intermediate the position most towards the end 236 of the ventilator and most towards a center of the ventilator, the ventilator 102 is in a partially open condition.

Figure 19:
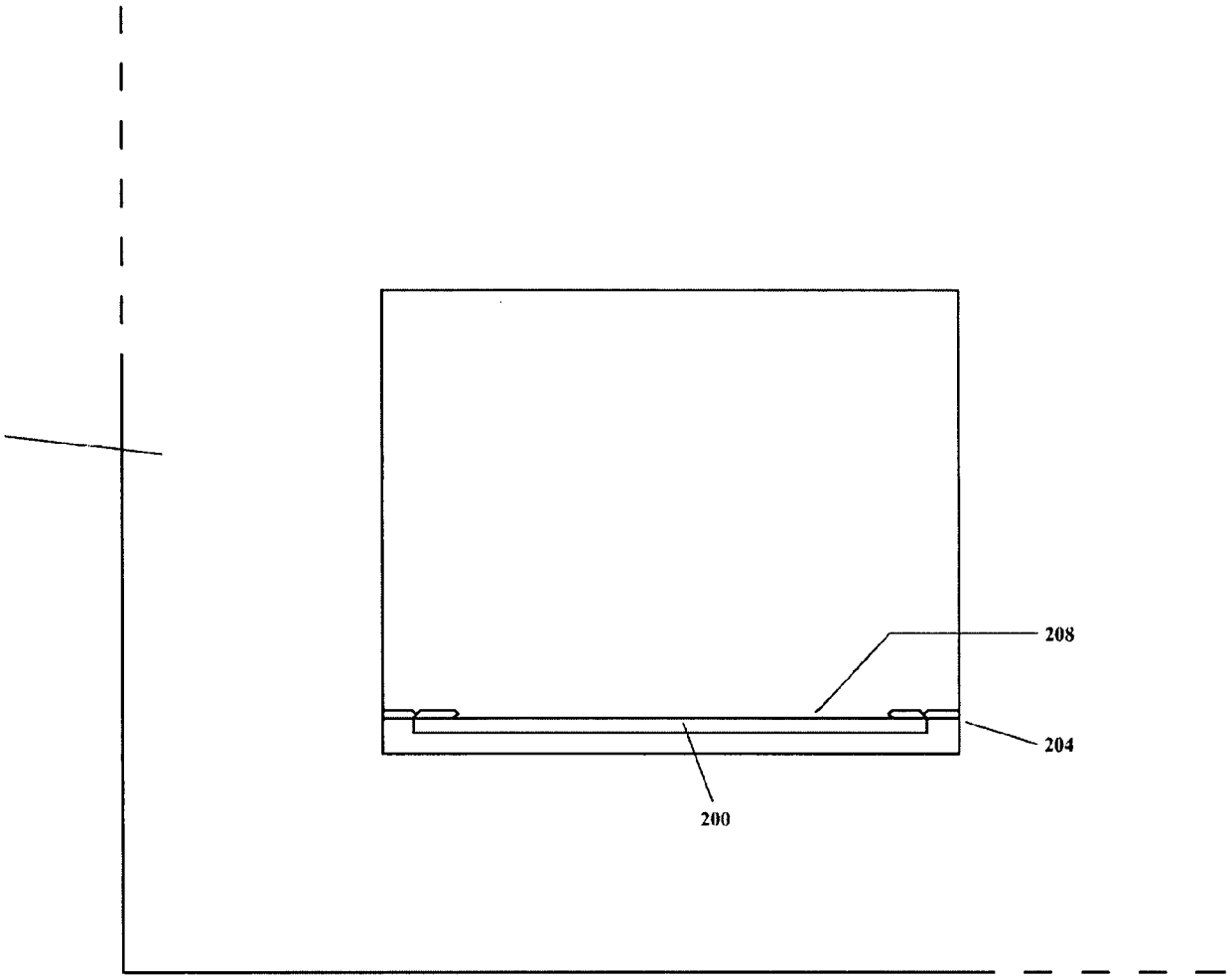
FIG. 19 is a perspective view of a slot ventilator installed in a curtainwall in accordance with one embodiment of the present invention.

FIG. 19 illustrates a slot ventilator 200 installed in a curtainwall 202 in accordance with one embodiment of the present invention. In curtainwall structures, the external wall of the structure is not load-bearing and instead is supported by structure such as floors. The curtainwall supports its own load and environmental loads, and forms an enclosure for a building. As shown, the ventilator 200 is provided along a bottom portion 204 of a window opening 206 in the curtainwall 202. A windowsill 208 may be provided in the window opening 206 with the ventilator 200 installed in the windowsill 208 as described above.

Although the present invention has been described with reference to preferred embodiments, persons skilled in the art will recognize that changes may be made in form and detail without departing from the spirit and scope of the invention.

I claim:

1. A slot ventilator comprising:

a housing including first and second sidewalls, an airflow opening, the airflow opening being adapted to receive a closure member and serving as a pathway through which ventilation air may pass when the ventilator is in an open condition;

first and second block assemblies, the first and second block assemblies being coupled to first and second ends of the housing, each block assembly including a base portion and a block latch portion;

a closure member including a top portion;

first and second clip assemblies, the first and second clip assemblies being coupled to first and second ends of the closure member and being generally opposite the first and second block assemblies, each clip assembly including a clip latch portion and a handle portion, the handle portion being secured to the clip latch portion via a fastener, each fastener being configured for displacement with respect to the closure member; and first and second shaft assemblies, the first and second shaft assemblies each including a shaft and a sleeve such that the shaft extends through the sleeve in a path that is generally perpendicular to the top portion of the closure member and is displaced through the sleeve when the closure member displaces from an open condition to a closed condition;

wherein the block latch portion is configured to mate with the clip latch portion to form a latch mechanism that may be used to secure the closure member against the housing in a closed condition and wherein, in the closed condition, the closure member abuts against an upper surface of the housing and generally obstructs the airflow opening, and, in the open position, the closure member is offset from the upper surface of the housing and the airflow opening is generally unobstructed by the closure member.

2. The ventilator of claim 1, further comprising first and second slots in the top portion at each end of the closure member, wherein each fastener of the first and second clip assemblies is configured for displacement in the respective slot of the closure member to effect displacement with respect to the closure member and wherein the block latch portion is a lip portion and the clip latch portion is a clip portion, the lip portion and the clip portion being configured such that clip portion engages the lip portion when the ventilator is in a closed condition.

3. The ventilator of claim 2, wherein each clip assembly may displace along its respective slot to engage or disengage the respective clip portion of the block assembly, each clip portion of the clip assembly thus being adapted to mate with a respective lip portion of the block assembly.

4. The ventilator of claim 1, further comprising one or more slots in the top surface configured for opening or closing to provide partial venting to the ventilator.

5. The ventilator of claim 1, further comprising a keylock such that the ventilator may be locked in the open condition or in the closed condition.

6. The ventilator of claim 1, wherein the first and second shaft assemblies further comprise a spring, a sleeve and a bottom stop and each shaft is coupled to a bottom surface of the top portion of the closure member and extending down its respective spring and sleeve to terminate at the bottom stop.

7. The slot ventilator of claim 1, wherein the shaft is telescopically displaceable in said sleeve.

8. The slot ventilator of claim 1, wherein a first end of the shaft extends from a first end of the sleeve and attaches to the closure member, and a second end of the shaft extends from a second end of the sleeve and attaches to a stop.

9. The slot ventilator of claim 8, wherein the shaft further comprises a spring.

10. The slot ventilator of claim 9, wherein the spring is positioned between the closure member and the first end of the sleeve.

11. The slot ventilator of claim 10, wherein the spring is centered about the shaft.

12. The slot ventilator of claim 8, wherein the shaft is threaded.

13. The slot ventilator of claim 12, wherein the stop is threaded.

14. The slot ventilator of claim 13, wherein the stop and shaft enable a displacement distance between the closure member and the housing to be adjusted.

15. The slot ventilator of claim 1, wherein the block latch portions and the clip latch portions are engaged by moving the first and second handles towards each other.

16. The slot ventilator of claim 1, further comprising a biasing mechanism biasing the closure member towards the closed condition.

17. The slot ventilator of claim 1, wherein the closure member further includes a reinforcing portion, the reinforcing portion intersecting the top portion.

18. The slot ventilator of claim 17, wherein the reinforcing portion is positioned approximately central first and second outer edges of the top portion and extends downwardly from the top portion.

19. A slot ventilator comprising:

a housing including a face with an airflow opening defined in said face and a sleeve, wherein the sleeve has a longitudinal axis generally perpendicular to the face the housing further including a lip portion that forms a first half of a latching mechanism; and a closure member including a shaft displaceable in the sleeve wherein the latching mechanism is adapted to latch the closure member in a first position, wherein the sleeve extends in a path that is generally perpendicular to the face when the closure member displaces from the first position to a second position, wherein, when the closure member is in the first position, the closure member abuts against the face and generally obstructs the airflow opening, wherein, when the closure member is in the second position, the closure member is offset from the face and the airflow opening is generally unobstructed by the closure member, wherein the closure member further includes a clip portion that forms a second half of the latching mechanism, wherein the closure member comprises a clip assembly, the clip assembly including the clip portion, the closure member further including a slot therein and a handle coupled to the clip portion, wherein the handle and clip portion are displaceable as an integral unit along the slot to engage and disengage the clip portion from the lip portion of the housing.

20. The slot ventilator of claim 19, wherein the slot is oriented generally parallel to the longitudinal length of the closure member.

21. The slot ventilator of claim 20, wherein the clip portion is disengaged from the lip portion by displacing the handle along the slot towards the longitudinal middle of the closure member.

22. A curtainwall unit comprising:

a section of curtainwall, the section of curtainwall including a window opening;

a window frame positioned in the window opening;

a slot ventilator positioned in a portion of the window frame, the slot ventilator comprising a housing including an airflow opening, the airflow opening being adapted to receive a closure member and serving as a pathway through which ventilation air may pass when the ventilator is in an open condition;

first and second block assemblies, the first and second block assemblies being coupled to first and second ends of the housing, each block assembly including a block latch portion;

a closure member including a top portion;

first and second clip assemblies, the first and second clip assemblies being coupled to first and second ends of the closure member and being generally opposite the first and second block assemblies, each clip assembly including a clip latch portion; and first and second shaft assemblies, the first and second shaft assemblies each including a shaft and a sleeve such that the shaft extends through the sleeve in a path that is generally perpendicular to the top portion of the closure member and is displaced through the sleeve when the closure member displaces from an open condition to a closed condition;

wherein the block latch portion is configured to mate with the clip latch portion to form a latch mechanism that may be used to secure the closure member against the housing in a closed condition and wherein, in the closed condition, the closure member abuts against an upper surface of the housing and generally obstructs the airflow opening, and, in the open position, the closure member is offset from the upper surface of the housing and the airflow opening is generally unobstructed by the closure member.

23. The curtainwall unit of claim 22, wherein the window frame includes a windowsill and the windowsill includes an opening for receiving the ventilator.

24. The curtainwall unit of claim 23, wherein the housing includes an upper rim and a pair of opposing sidewalls, the rim resting on the windowsill and the opposing sidewalls extending vertically downward into the opening.

25. The curtainwall unit of claim 24, wherein fasteners couple the rim to the windowsill.

26. A window wall unit comprising:

a section of window wall, the section of window wall including a window opening;

a window frame positioned in the window opening;

a slot ventilator positioned in a portion of the window frame, the slot ventilator comprising a housing including an airflow opening, the airflow opening being adapted to receive a closure member and serving as a pathway though which ventilation air may pass when the ventilator is in an open condition;

first and second block assemblies, the first and second block assemblies being coupled to first and second ends of the housing, each block assembly including a block latch portion;

a closure member including a top portion;

first and second clip assemblies, the first and second clip assemblies being coupled to first and second ends of the closure member and being generally opposite the first and second block assemblies, each clip assembly including a clip latch portion; and first and second shaft assemblies, the first and second shaft assemblies each including a shaft and a sleeve such that the shaft extends though the sleeve in a path that is generally perpendicular to the top portion of the closure member and is displaced though the sleeve when the closure member displaces from an open condition to a closed condition;

wherein the block latch portion is configured to mate with the clip latch portion to form a latch mechanism that may be used to secure the closure member against the housing in a closed condition and wherein, in the closed condition, the closure member abuts against an upper surface of the housing and generally obstructs the airflow opening, and, in the open position, the closure member is offset from the upper surface of the housing and the airflow opening is generally unobstructed by the closure member.

* * * * *